United States Patent [19]

Cameron

[11] 4,037,728

[45] July 26, 1977

[54] CLAMP FOR GARMENT RACKS

[76] Inventor: Anson W. Cameron, 945 Manor Drive, Wilmette, Ill. 60091

[21] Appl. No.: 721,036

[22] Filed: Sept. 7, 1976

[51] Int. Cl.[2] ..... A47F 5/00

[52] U.S. Cl. ..... 211/124; 211/7

[58] Field of Search ..... 211/124, 105.1, 89, 211/7, 8, 9; 248/214; 16/960, 93 R

[56] References Cited

U.S. PATENT DOCUMENTS

| | | | |
|---|---|---|---|
| 3,283,914 | 11/1966 | Robinson | 211/7 X |
| 3,298,503 | 1/1967 | Field et al. | 211/124 X |
| 3,458,051 | 7/1969 | Zeman et al. | 211/124 X |
| 3,472,385 | 10/1969 | Shapiro et al. | 211/124 X |
| 3,519,139 | 7/1970 | Brennan | 211/124 |
| 3,613,898 | 10/1971 | Brennan | 211/124 |
| 3,921,814 | 11/1975 | Solomon | 211/124 X |

*Primary Examiner*—Roy D. Frazier
*Assistant Examiner*—Robert W. Gibson, Jr.
*Attorney, Agent, or Firm*—Leydig, Voit, Osann, Mayer & Holt, Ltd.

[57] ABSTRACT

A clamping assembly for clamping garment hangers to a tubular horizontal hanger bar for transport. The assembly includes a longitudinally extending clamping bar having clips at the respective ends, each clip being formed of a spring band of resilient metal closed in a continuous loop and bent into an open figure eight configuration including upper and lower lobes. Each of the lobes is somewhat larger than the diameter of the hanger bar, the spring band being deformed inwardly between the lobes to provide a central obstruction in the form of a gap having a width less than the diameter of the hanger bar so that the movement of the hanger bar is detented as the bar is moved between the lobes. A strip of resilient rubber-like material is secured longitudinally along the underside of the clamping bar and serves not only to engage the garment hangers on the hanger bar during transport but to bias the hanger bar against the central obstruction in rattle-free condition on the return trip.

3 Claims, 11 Drawing Figures

CLAMPED FOR LOADED TRANSPORT

DETENTING

CLAMPED FOR EMPTY RETURN TRIP

FULLY UNCLAMPED

HANGERS UNLOADED

ASSEMBLE

CLAMP FOR GARMENT RACKS

When hangers supporting garments are transported on a tubular trolley bar or the hanger bar of a hand truck or other conveyance, it is possible for the hooks of the hangers to be unseated as a result of slight jostling or upon encountering a small bump or irregularity. The need for some means for temporarily clamping the hooks of the hangers on a hanger bar during transport has been recognized for a number of years, but the available clamping structures have not been satisfactory for a number of reasons, because of difficulty of application or release, because of unreliability, because of required drilling, cutting or other modification of the hanger bar, or because of the high cost of equipping the large number of hanger bars used in a typical garment merchandising business.

It is, accordingly, an object of the present invention to provide a clamping assembly for clamping garment hangers to a hanger bar which is of inherent low cost, which is reliable, which may be manipulated by light hand pressure, and which may be used universally, both as a part of a new hanger bar trolley or other assembly or as an addition to a hanger bar already in the field.

It is a related object to provide a clamping assembly for a hanger bar which has reliable and predictable clamping characteristics, which may be inexpensively manufactured with a wide range of dimensional tolerance, which is capable of automatic accommodation to different hanger bars having a range of diameter as may be encountered in the field, and which is capable of simultaneous clamping of widely different hanger hooks having a variety of size, curvature and material cross section.

It is a general object of the present invention to provide a clamping assembly which may be economically constructed and assembled and which is inherently durable having a long useful life even in the face of hardest usage.

It is a more detailed object to provide a clamping assembly which is not only effective to clamp hanger hooks when in loaded condition but which is effective to apply a clamping force when in empty condition to prevent rattling on the return trip. Other objects and advantages of the invention will become apparent upon reading the attached detailed description and upon reference to the drawings in which.

Figure 3:
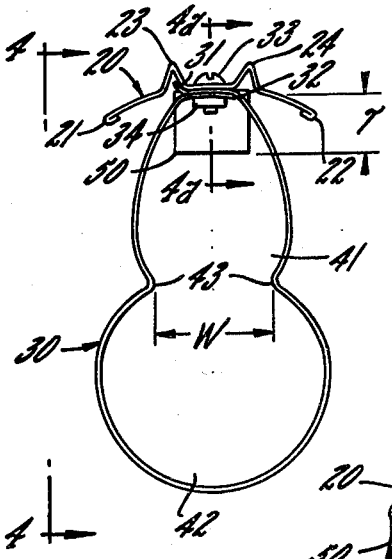
FIG. 3 is an end view of the clamping assembly looking along the line 3—3 in FIG. 2.
Figure 4:
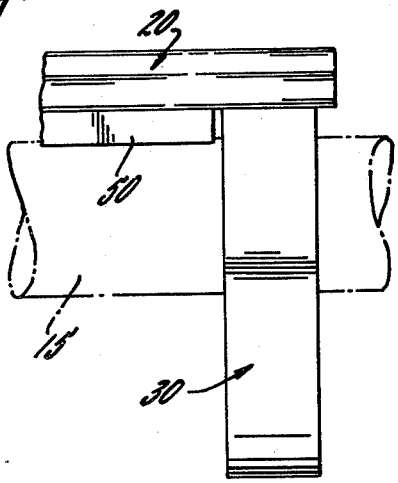
FIG. 4 is an enlarged fragmentary elevation of one end of the clamping assembly, looking along line 4—4 in FIG. 3.
Figure 4A:
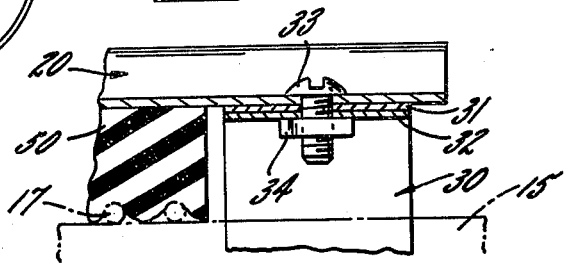

FIG. 4*a* is a fragmentary section showing use of a machine screw as a securing means, looking along the line 4*a*—4*a* in FIG. 3.

FIGS. 5*a*–5*e* are a series of stop motion views respectively showing the device clamped for transport, traversing the detent, in unclamped position, being unloaded, and clamped for the return trip.

Figure 6:
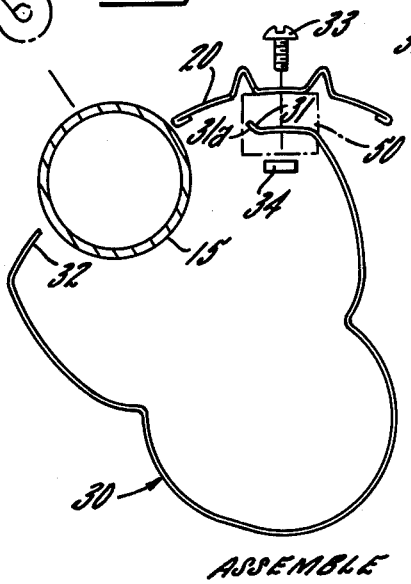

FIG. 6 is a view similar to FIG. 3 and showing the manner in which the clamping means is assembled in captive position upon an existing hanger bar.

While the invention has been described in connection with a preferred embodiment, it will be understood that I do not intend to be limited to the particular embodiment shown but intend, on the contrary, to cover the various alternative and equivalent forms of the invention included within the spirit and scope of the appended claims.

Figure 1:
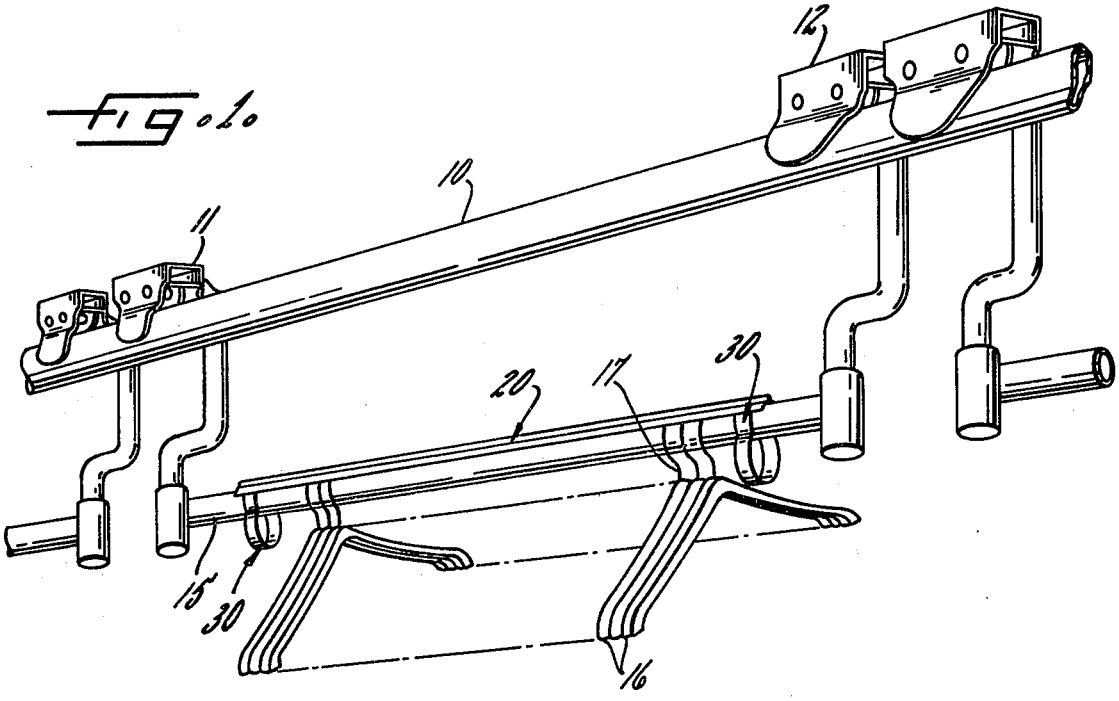
FIG. 1 is a perspective view of a trolley carrying a plurality of hangers normally having garments supported thereon and utilizing a clamping assembly constructed in accordance with the present invention to keep the hangers securely seated.

Turning now to the drawings there is shown a trolley 10 having first and second roller assemblies 11, 12 riding upon a rail 13. Extending, in depending position, between the roller assemblies, and captive with the latter, is a tubular trolley bar or hanger bar 15. Suspended on the hanger bar are a plurality of hangers 16, each hanger having a hook 17. Although garments are not illustrated in FIG. 1, it will be understood that the hangers 16 each carry a garment, for example, from the point of storage to the sales floor. It will be further understood that the invention, while illustrated in connection with a trolley, is not limited to use with trolleys and that the invention may be employed wherever it is desired to clamp the hooks of a series of hangers to a hanger bar on a temporary basis and to prevent dislodgement during transport or storage.

Figure 2:
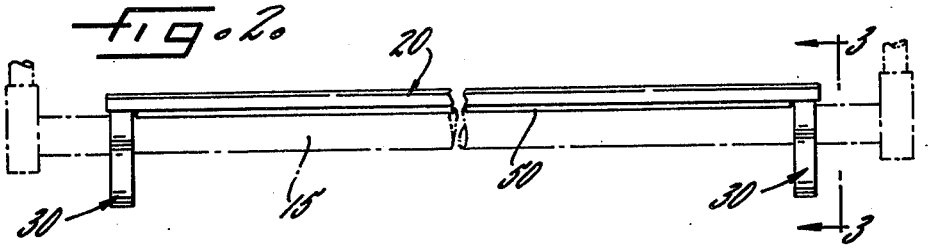
FIG. 2 is a side elevational view of a clamping assembly mounted on a horizontal hanger bar, the bar being shown in dot-dash outline.

In accordance with the present invention the hooks of the hangers are clamped to the hanger bar by means of a clamping bar which extends longitudinally along, and parallel to, the hanger bar and which has a clip at each end for holding the two bars captive with respect to one another, each clip being formed of a closed spring band of resilient metal bent into an open "figure eight" configuration to define upper and lower lobes and with the spring band being deformed inwardly between the lobes to provide a central obstruction in the form of a gap of a width less than the diameter of the hanger bar so that movement of the hanger bar is detented as such bar is moved between one of the lobes and the other, relatively. Thus, referring particularly to FIGS. 2–4, the clamping bar indicated at 20 is preferably of arcuate shape, formed of light metal by a rolling operation, and having longitudinally extending beads imparting a high degree of rigidly. Thus, the clamping bar 20 has beaded, or rolled, lateral edges 21, 22 and parallel upstanding, longitudinally extending beads 23, 24. At each of its ends the clamping bar has a resilient retainer clip 30 formed of a spring band of resilient metal, preferably spring steel, which is bent into an open figure eight configuration. The ends of the band, indicated at 31, 32 are overlapped on the underside of the clamping bar and are provided with registering apertures for engagement by a tightenable fastener in the form of a machine screw 33 and cooperating nut 34. However, the nut may be dispensed with where the screw 33 is of the self-tapping type having a tight frictional and clamping engagement with the receiving aperture in the end 32 of the spring band.

In carrying out the invention the spring band is permanently bent in the configuration illustrated in FIG. 3 defining a figure eight having an upper lobe 41, a lower lobe 42 and inwardly extending creases, or deformations defining a central obstruction 43 providing a gap of width W which is less than the diameter of the hanger bar. For example, where the hanger bar has a nominal diameter of one inch, the gap may have a width on the order of three-quarters of an inch so that the movement of the hanger bar is detented as the bar is relatively moved between one of the lobes and the other, that is, between free and clamping positions. To insure rotational freedom in the "free" position, the lobe 42 may be slightly larger than the lobe 41, although, if desired, both lobes may be of approximately the same diamter, each providing limited clearance with respect to the contained hanger bar.

In accordance with one of the important features of the invention there extends longitudinally along the underside of the clamping bar a strip of resilient rubber or rubber-like material which may, for example, be foamed to provide a large compression factor, that is, a large ratio of normal thickness to the thickness in a fully compressed state. The strip, indicated at 50, may be secured in place on the bar by a suitable cement. In carrying out the invention the strip of resilient material performs two separate functions, it provides intimate frictional engagement with the hooks of adjacent hangers, which may be of different curvature and material cross section and it serves also to bias the hanger bar relatively against the central obstruction 43 thereby to prevent looseness or rattling between the hanger bar and the clips without relying upon the resilience of the spring metal of which the clips are formed. Preferably, the resilient strip has a relatively low spring rate, a spring rate which is less than the effective spring rate of the obstruction 43 so that the strip is incapable, by its own action, and under conditions of normal loading, of relatively forcing the hanger bar through and beyond the obstruction 43 which would defeat the detenting action. Soft foam rubber or foamed resilient plastic of either the "closed" cell or "open" cell type may be used.

The resilient strip in any event has sufficient thickness T in the transaxial direction (see FIG. 3) so as to bias the hanger bar against the central obstruction 43 thereby to prevent looseness and rattling between the hanger bar and clamping assembly during transport in the empty condition. This will be brought out in connection with a series of stop motion views, FIGS. 5*a*–5*e*, illustrating a typical operating cycle.

Figure 5A:
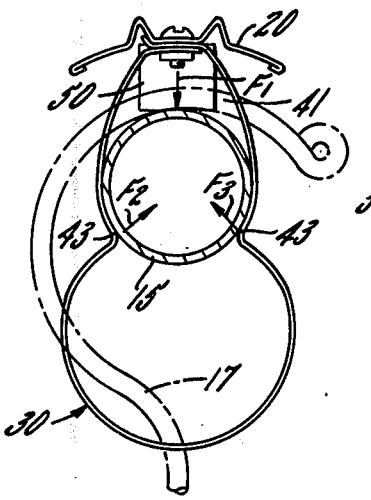
Figure 5B:
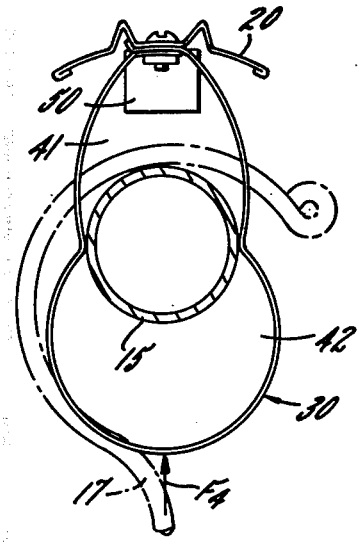
Figure 5E:
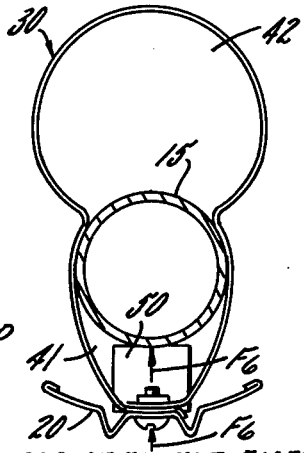

In the condition shown in FIG. 5*a* the hanger bar 15 occupies a clamping position in the upper lobe 41. In the clamping condition the force developed by compression of the resilient strip 50 provides a clamping force F1 which is exerted upon the hanger bar and which is resisted by reaction forces F2, F3 at the central obstruction 43. As long as the resilient strip is sufficiently thick to generate forces F1–F3 there will be no possibility of looseness. In a typical design in accordance with the present invention, the total force F1 exerted by the reaction of the compressed resilient strip, and which serves to hold the hanger hooks in place, may be on the order of 10 pounds. Using a spring clip made of hardened and tempered steel, for example, type 1075, having a width of one-half inch and a thickness of 0.023 inch, such force is successfully opposed by the reaction forces F2, F3, thus guaranteeing that the hangers, and the garments thereon, will remain securely in position during normal or sever jostling which may be encountered during transport.

When the loaded hanger bar reaches its destination the clamping bar is released by applying a relative releasing force F4 (see FIG. 5*b*) to the underside of the clips 30, thereby forcing the hanger bar 15, with detent action, relatively past the obstruction 43. Such force can be conveniently applied simultaneously to the clips by the thumbs of the user, with the fingers being braced by curling over the top of the hanger bar. It is found in practice that maximum detenting forces of as high as ten pounds or more can be readily overcome in this manner, even by a child, although, in a practical case, the device can be designed for an operating force of about half this amount.

In any event, overcoming the detent causes the clamping assembly to move relatively upwardly, beyond the obstruction, and into a position where the hanger bar occupies the lower lobe 42 (see FIG. 5*c*) fitting loosely therein.

Figure 5C:
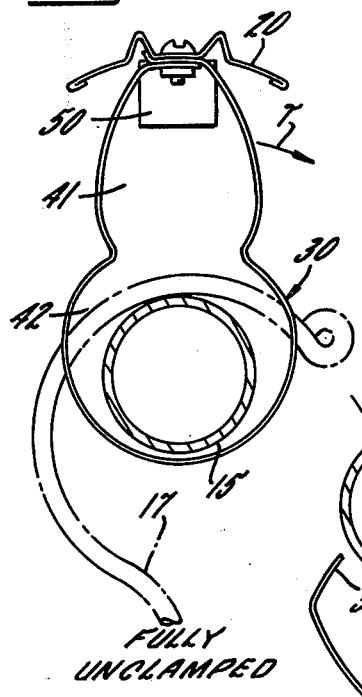
Figure 5D:
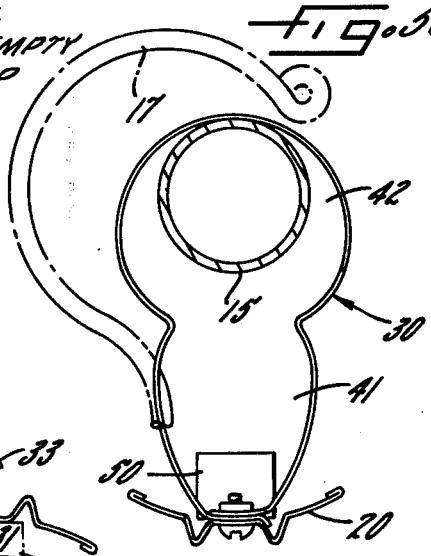

With the clamping assembly in its unclamped position, it can be released and manually allowed to topple in the direction indicated at T in FIG. 5*c*. Continuation of the toppling movement occurs, under the action of gravity, and without any care or attention of the user until the clamping assembly occupies the fully inverted position shown in FIG. 5*d* in which the hooks 17 of the hangers are free to be lifted from the hanger bar 15 without obstruction, just as though the clamping assembly were not present.

For the return trip, with the hanger bar now empty, the device is restored to its clamped condition by pressing upwardly with the thumbs against the ends of the clamping bar 20, with the fingers again being curled about the hanger bar, and applying a force indicated at F5 (FIG. 5*e*) until the hanger bar passes by the detenting obstruction 43 and into the "upper" lobe 41 of the clip. The thickness T of the strip 50 is, as stated, sufficiently great so that the strip is slightly compressed, even in the absence of hangers, to exert a reaction force F6, which is at least on the order of several ounces, thereby to press the hanger bar relatively against the central obstruction to prevent looseness or rattling on the return trip.

While the invention has particular utility on a hanger bar forming a part of a trolley, it will be understood that the invention is by no means limited thereto and that the present clamping assembly may be employed with equal advantage to keep hangers, and garments thereon, secure on a hanger bar during any transport or storage. It is one of the features of the clamping assembly that it may be assembled directly on a hanger bar in captive position, particularly on a hanger bar which is already in the field, to form a permanent combination. Such assembly is performed as shown in FIG. 6, where it will be noted that the ends 31, 32 of the spring band may be resiliently spread apart for admission of the hanger bar 15, following which the ends 31, 32 may be overlapped with a clamping bar 20 in a superimposed position, and with the screw openings in register, followed by insertion and tightening of the screw. Either a machine screw may be employed, requiring a nut 34, or a metal tapping screw may be used having a tight fit with the opening in the end 32 of the spring band. Alternatively, a "pop" rivet may be used It is one of the more detailed features of the present invention that the end 31 of the spring band may be bent upwardly, that is radially outward, to form a lip 31*a* which registers with the groove on the underside of the clamping bar formed by the longitudinally extending bead 23. Thus once the screw 33 is tightened, with the lip 31*a* seated in the groove, no relative rotation of the spring band can occur so that the screw 33, once firmly tightened, is tightened for all time.

As an alternative construction, the ends of the spring band may terminate in the bottom position, with overlapping and fastening by a screw or other suitable fastener, thereby permitting the upper loop of the clip to be permanently spot welded to the underside of the clamping bar 20. In either event, it is important that the spring band form a continuous closed loop thereby permitting adequate detenting force to be developed using a spring band of only limited width and thickness. The amount of detenting effect can be controlled by controlling the gap width W (FIG. 3), the positiveness of the detent being inversely related to the width of the gap. It is to be particularly noted that, using the geometry set forth, and in spite of the relatively large tube diameter, detenting action is abrupt at the beginning of the stroke. Stated in other words, the detent force curve provides a retention without idle initial motion, thereby fully utilizing the resiliency of the rubber strip 50 while still permitting easy manipulation.

By the term "open figure eight configuration" used herein is meant that the spring band is formed into an upper lobe and a lower lobe which are in open communication through a central neck or gap of limited width forming a resilient obstruction.

While the clamp described above has particular application to the transport of hangers in loaded condition, it will be apparent that the clamping assembly may be also employed as a "caddy" for the organized return of empty hangers from the sales floor to the warehouse or other facility where the garments are originally received and tagged. In such usage the hanger bar 15 will not include the trolley feature but will preferably have enlargements at the respective ends for holding the clamping assembly permanently captive.

The spring clips 30 are located at the ends of the clamping bar in the illustrated embodiment, but it will be understood that the clips may be spaced inwardly of the ends if desired, either by a small amount or by a greater amount up to, say, one-quater of the length of the bar, the term "adjacent" used herein covering these various possibilities. In such event the clamping bar should be as long as the space available above the trolley bar to insure that the "end" hangers are maintained captive.

What I claim is:

1. In a clamping assembly for clamping garment hangers to a tubular horizontal hanger bar for transport, the combination comprising a longitudinally extending clamping bar extending along and parallel to the hanger bar, a clip adjacent each end of the clamping bar for holding the clamping bar captive on the hanger bar, each clip being formed of a spring band of resilient metal closed in a continuous loop and bent into an open figure eight configuration forming upper and lower lobes, the clamping bar being secured to the clips at the upper lobes thereof, each of the lobes being somewhat larger than the diameter of the hanger bar and with the spring band being deformed inwardly between the lobes to provide a central obstruction in the form of a gap of a width substantially less than the diameter of the hanger bar so that the movement of the hanger is detented as such bar is relatively moved between one of the lobes and the other, and a strip of resilient rubber-like material extending longitudinally along the underside of the clamping bar and secured to the latter to bear against the hooks of the garment hangers on the hanger bar when the hanger bar occupies the upper lobe of the clips during transport in loaded condition, the resilient strip being relatively soft and of sufficient thickness as to bias the hanger bar against the central obstruction when the hanger bar occupies the upper lobe of the clips during transport empty on the return trip thereby to insure a snug fit and to prevent rattling of the clamping assembly on the hanger bar.

2. The combination as claimed in claim 1 in which the ends of the spring band are provided with registering apertures and overlapped at the top of the upper lobe and in which a further registering aperture is provided in the clamping bar, all of the apertures being engaged by a tightenable fastener which upon tightening serves to close the clip, to anchor it to the clamping bar, and to hold it captive on the hanger bar.

3. The combination as claimed in claim 2 in which the clamping bar includes at least one longitudinally extending bead for purposes of rigidification presenting a groove on the underside and in which the outer overlapping end of the spring band is bent radially outwardly to form a lip in register with the groove, thereby to prevent rotation of the clip out of its plane following tightening of the fastener.

* * * * *